United States Patent [19]

Scott et al.

[11] 3,973,821

[45] Aug. 10, 1976

[54] CONNECTOR

[75] Inventors: William J. Scott; James F. Lucas, both of Sycamore, Ill.

[73] Assignee: Ideal Industries, Inc., Sycamore, Ill.

[22] Filed: Nov. 29, 1974

[21] Appl. No.: 527,958

[52] U.S. Cl. ..... 339/266 R

[51] Int. Cl.[2] ..... H01R 7/06

[58] Field of Search ..... 339/97 R, 266 R, 266 F, 339/266 G, 266 L, 274

[56] References Cited

UNITED STATES PATENTS

| | | | |
|---|---|---|---|
| 1,411,263 | 4/1922 | Bellis | 339/274 |
| 3,118,720 | 1/1964 | Shuck | 339/266 R |
| 3,328,747 | 6/1967 | Dover et al. | 339/274 |
| 3,351,889 | 11/1967 | Lawlor et al. | 339/97 R |
| 3,579,177 | 5/1971 | Lawlor | 339/266 R X |
| 3,801,952 | 4/1974 | Lawlor | 339/266 R |
| 3,831,134 | 8/1974 | Cornell et al. | 339/266 R |
| 3,861,771 | 1/1975 | Cornell | 339/266 R X |

FOREIGN PATENTS OR APPLICATIONS

| | | | |
|---|---|---|---|
| 1,188,953 | 4/1970 | United Kingdom | 339/266 R |

*Primary Examiner*—Joseph H. McGlynn
*Assistant Examiner*—Howard N. Goldberg
*Attorney, Agent, or Firm*—Kinzer, Plyer, Dorn & McEachran

[57] ABSTRACT

This is concerned with a connector for clamping the ends of cables which have had their insulation removed which includes a ball and socket where the socket is stationary and the ball rotates to a certain limited amount to grasp and distort the metal of the cable sufficiently to firmly hold it in place and to complete an electrical joint between the cable and a surface or part to which the connection is being made.

7 Claims, 9 Drawing Figures fig. 7.
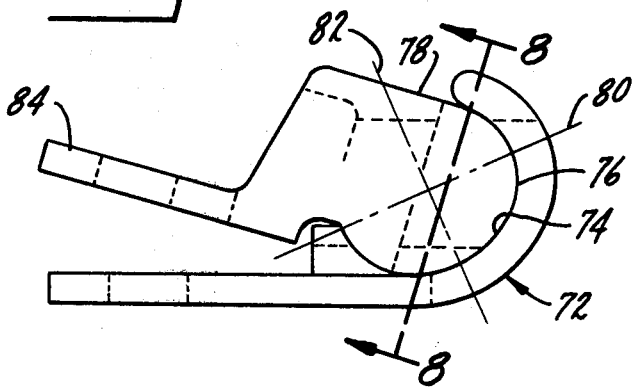
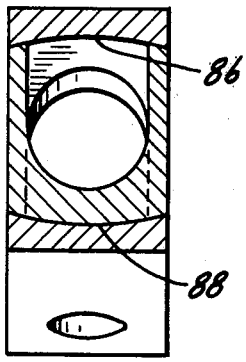
fig. 8.
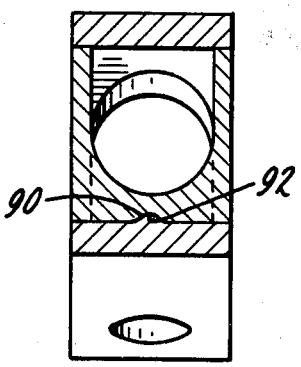
fig. 9.

CONNECTOR

SUMMARY OF THE INVENTION

This invention is concerned with a clamp connector for cables which have had the insulation removed from a certain extent of the end thereof, commonly referred to as the strip end, and is more specifically concerned with a new and improved cable clamp connector which has the advantage of being in two pieces in the nature of a terminal lug which can be installed without the use of a torque wrench or crimping tool.

A primary object of the invention is a terminal lug or cable clamp connector of the above type which reduces the risk of improper installation.

Another object is a connector of the above type in which a ball rotates inside of a stationary socket to crimp or distort the metal of the wire to just the right degree.

Another object is a connector of the above type which has a better mechanical advantage and is therefore easier to operate and use than prior connectors.

Another object is a connector of the above type which is simple to manufacture.

Another object is a connector of the above type in which the crimping force tends to open the socket, during crimping, thereby eliminating any tendency for the unit to bind up or gall.

Another object is a connector of the above type which may be cast, extruded or fabricated.

Another object is a connector of the above type which is constructed to be normally open.

Another object is a connector of the above type which has an axial interlock to prevent the ball and socket from coming apart.

Other objects will appear from time to time in the ensuing specification and drawings.

BRIEF DESCRIPTION OF THE DRAWINGS

FIG. 7 is a side view of a variant form;

FIG. 8 is a section along line 8—8 of FIG. 7; and

FIG. 9 is also a section along line 8—8 of FIG. 7 of a modified form.

DESCRIPTION OF THE PREFERRED EMBODIMENT

In FIGS. 1–4 a preferred form of the invention is shown in which the clamp connector includes two basic elements, a socket element designated generally 10 and a ball element designated generally 12. The ball is disposed generally in the socket and is adapted to rotate therein. And while the ball and socket have been referred to as such, it will be noted that they do not necessarily have three-dimensional curvature, but rather only two dimensional. So in the strict sense of a ball having a three-dimensional exterior curvilinear surface, the units shown are somewhat different. The same is true of the socket. But these terms have been selected as possibly the most appropriate for the structure, function and action of the various parts involved.

Figure 3:
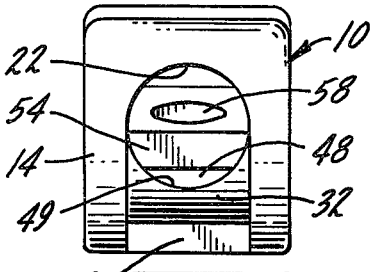
FIG. 3 is an end view of FIG. 2.

Considering socket 10 first, it will be noted that the socket has a head or curved portion 14 which merges into a generally rectilinear tail 16 which is disposed generally tangential to the curve or circle of the head. The head 14 does not extend all the way around, but rather terminates at 18 so that it is not closed. And the point of termination 18 may be determined based upon engineering and manufacturing considerations. The head itself has a channel or opening 20 which extends from a point 22 more or less adjacent the terminal extremity 18 to a point 24 which is in the vicinity of the tangential junction between the curvilinear head and the rectilinear tail. The upper terminal surface 22 is also curved, as shown in FIG. 3, and may be shaped to provide a suitable wire distorting surface or anvil. The lower terminal surface 24 may assume any suitable shape, as shown in FIG. 3, and the joining sides, as shown in FIG. 3, may be generally straight and parallel.

Figure 1:
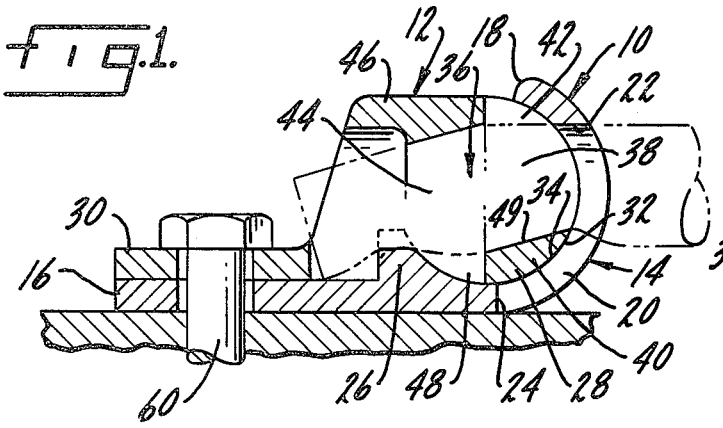
FIG. 1 is a side view, partly in section, of a preferred form of the invention.
Figure 4:
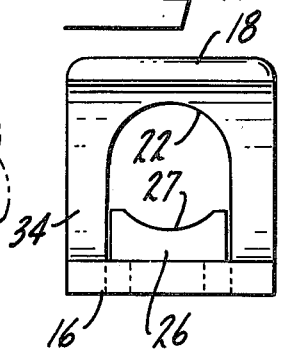
FIG. 4 is an end view of the socket alone.

A riser 26, which is integrally formed with the tail 16 and socket 14, is disposed on the upper surface thereof generally at their junction point and is topped by a crown or arc 27 which is curvilinear or arcuate in a direction laterally across the socket element so as to provide a wire-distorting surface to act generally in accordance with the broken lines shown in FIG. 1. In lateral width the entire riser 26 is somewhat foreshortened on each side so that it is centered on the tail 16 to project up into an opening through the ball element as explained hereinafter.

Figure 2:
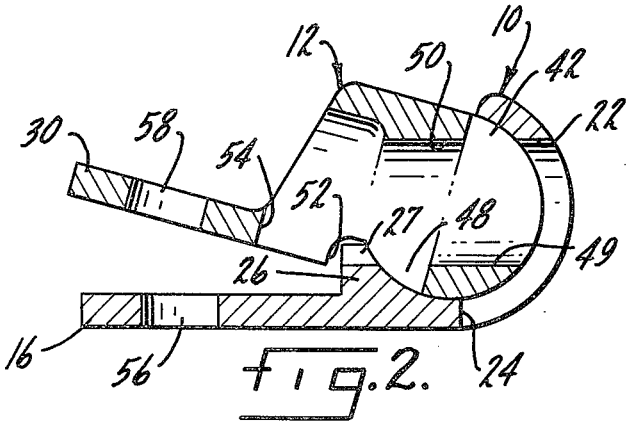
FIG. 2 is a side view, similar to FIG. 1, in section showing the connector open.

The ball element 12 includes a ball 28, as defined previously, with a tail 30 extending therefrom in a direction that may be considered more or less tangent to the circular exterior surface 32 of the ball. The circular exterior surface 32 fits inside of and meshes, so to speak, with the circular interior surface 34 in the socket element with a certain degree of clearance being provided so that the ball may rotate freely in the socket. The ball has a generally diametrical passage therethrough, designated generally 36, which may be considered in two halves, first the inlet half 38 which is closed on the bottom at 40 and open on the top at 42 and the inside half 44, which may be considered to be closed on top at 46 and open on the bottom at 48. Considering first the inlet half 38, the closed bottom thereof 40 is provided with a wire-engaging and distorting surface 49 which may be somewhat arcuate or curvilinear in cross section, as shown in FIG. 3, for reasons set forth hereinafter. The inner half 44, specifically the upper portion 46, has a more or less arcuate or curvilinear wire-engaging surface 50, as shown in FIGS. 2 and 3, with the lower or bottom half thereof being generally open for purposes set forth hereinafter. Notches are provided on each sidewall of the open bottom half, as indicated at 52, to accept the riser 26 when the parts are assembled. The forward or leading surface 54 of the ball tail 30 provides a wire stop or abutment.

The tails 16 and 30 are provided with registrable openings 56 and 58 at a suitable location therealong which are somewhat oversized, as shown in FIG. 1, relative to a bolt or connector 60 to be used therewith so that movement of the ball tail 30 may be provided for. The openings may be somewhat larger than the shank of the connector all the way around or merely elongated and therefore somewhat elliptical in a longitudinal direction, if desired.

Figure 5:
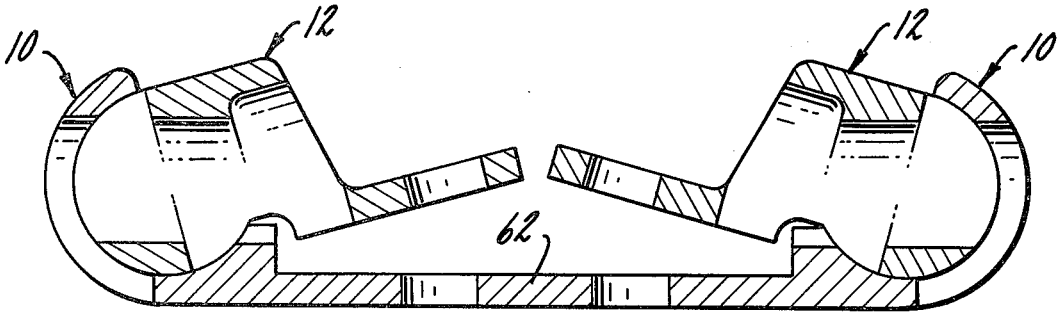
FIG. 5 is a side view in section of a modified form.

A variant form is shown in FIG. 5 in which the socket units are cast or made integrally with the tails thereof joined or integral at 62. And it will be understood that separate wires are inserted into the clamp connectors from opposite ends with bolts or connectors, such as 60 in FIG. 1, being used in separate registrable openings so that two wires may be joined to the surface or part therefor.

Figure 6:
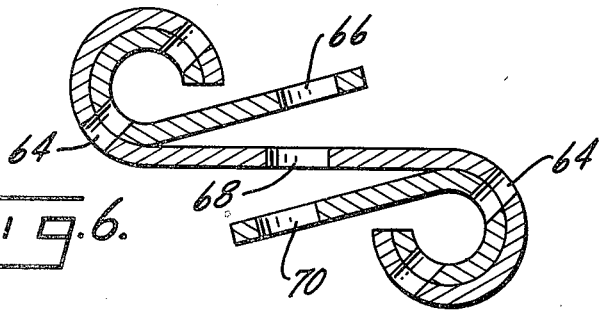
FIG. 6 is a side view in section of a further variant or modification.

In FIG. 6 a further variant has been shown in which the ball and socket may be considered to be made of sheet metal which has been appropriately formed into the shapes shown with diametrical openings 64 therethrough to accept a wire to be joined to make an electrical joint. As before, the socket may be considered to be stationary and the ball rotated by the use of a suitable connector, such as a bolt or the like. In FIG. 6 two ball and socket units have been shown with the socket tails joined or integral in what may be thought of as a back-to-back relation so the ball and socket tails, are on opposite sides of a plane through the socket tail, whereas in FIG. 5 they are on the same side. The FIG. 6 arrangement has the advantage that a single connector, such as bolt 60 in FIG. 1, may be inserted through the three aligned or registrable holes, 66, 68 and 70, whereas the FIG. 5 form requires separate bolts or connectors.

The unit in FIG. 6 may be a single unit such as in FIGS. 1–4 but made of sheet metal. As well, the double unit in FIG. 5 may be turned with the ball and socket elements back-to-back or on opposite sides of a plane through the unitary socket tails, like FIG. 6, if desired.

In FIG. 7 a further variant has been shown which is basically similar to the form in FIGS. 1–4 except that the engaged surfaces between the ball and socket are noncircular. For example, the socket 72 has its inner surface 74 as a portion of an ellipse, as does the exterior surface 76 of the ball 78. Considering the surfaces 74 and 76 as one, the ellipse may be considered to have major and minor axes 80 and 82 disposed at a suitable angle to the horizontal or vertical such that the elliptical surfaces match, when the parts are slipped together, so that the ball tail 84 is in a slightly open position. This has the advantage that the interior openings through the connector, which may be the same as in FIGS. 1–4, tend to stay aligned so that the stripped end of the wire may be inserted, whereas if the engaging or abutting surfaces are circular, such as in FIGS. 1–4, gravity will cause the connector to normally move to or stay in the closed position of FIG. 1. With the connector open, such as in FIG. 7, the stripped end of the wire may be easily inserted and the connector closed by a suitable bolt or the like, as in FIG. 1, which will tend to bind the ball in the socket due to the now misaligned position of the ellipses 74 and 76. This may well cause a slight spreading of the C-portion of the socket which can easily be accommodated. The crimping action or distorting of the end of the wire may be the same as in FIGS. 1–4.

In addition, the two parts are normally assembled by slipping the ball sideways or axially into the socket. And when the matching or engaging surfaces 74–76 are straight — cylindrical in FIG. 4 and elliptical in FIG. 7 — the two parts have a tendency to easily come apart. To prevent this, as shown in FIG. 8, the inner surface 86 of the socket is made slightly spherical in an axial direction and the outer surface 88 of the ball is also slightly sphered in an axial direction so that the parts are interlocked axially. This results in a slight interference fit which may require that the parts be press-fitted together or, in the case of thick sections, the sphere might have to be heated, but this is normally not considered necessary.

FIG. 9 is a section generally along line 8—8 of FIG. 7 and represents a further variation in which the engaged surfaces between the ball and socket may be considered generally straight or axial, but one of the surfaces, shown in this case or the socket, has a radius bead or ridge 90 around a certain portion of the inner periphery thereof which matches with a corresponding groove or indent or channel 92 around the exterior of the ball surface. As with FIG. 8, these two would require that they be forced together axially, but the result is an axial interlock which would keep the two parts together in use and during handling.

The use, operation and function of the invention are as follows:

In the unit shown in FIGS. 1–4, the terminal may accept a cable as shown in dotted lines in FIG. 1. The diametrical openings or passages through the ball and socket element will be generally aligned as shown in FIG. 2 and the stripped end of the cable may be inserted from the right. The units themselves may be made by die casting the separate elements so that a void is produced of a predetermined shape with many possible variations in order to permit internal serrations or other nonuniform shaped holes or passages to more efficiently and effectively grip the electrical conductor when the clamping action is carried out, as shown in FIG. 1. This permits the elimination of expensive machinery and the marking operations when compared to making the parts separately from extrusions. The holes through the tails could be punched to a larger size if a particular size or variation does not warrant a separate set of die castings. In fact, all of the stud holes or connecting openings could be punched or drilled. All of the holes could be fully cast without interlocking cores or an independently sliding core could be utilized. Thus the cores could be used, for example, in die casting the balls so that they are inserted from opposite directions to form one side of the diametrical passage closed and the other side open. The same is true of the socket. By the use of sliding cores and die casting, suitable serrations could be formed or any suitable surface configuration could be acquired, on the surfaces that are to distort the metal of the conductor.

The arrangement in FIG. 6 is intended to be made of sheet metal and the parts may be formed or stamped out of sheet metal of a suitable thickness. So the die casting approach does not apply to the FIG. 6 form.

The FIG. 1 arrangement has the advantage that the wire will abut the stop surface 54 when it is fully inserted and with the top half of the ball open, the wire will be visible through the opening both before and after installation which insures full insertion. Also, during the wire-distorting action when the tails are being closed from the FIG. 2 to the FIG. 1 position with the ball rotating inside of the socket, the forces involved will tend to expand or distort the socket so that it will tend to enlarge due to its open side or C-shape. There will be no tendency on the part of the socket to close around the ball resulting in a galling or binding action during crimping of the connector which will be the tendency where the ball stays stationary and the socket is rotated.

One of the advantages of rotating the ball with the socket fixed, instead of the other way around, is that the structure can be designed to permit changing the entering angle of the conductor that is being clamped relative to the terminal or part to which the clamp connector is attached. This is to say that the wire can be inserted and clamped at a number of angles relative to the axis of the screw or stud that operates and mounts the clamp. This gives great flexibility and design possibilities.

While clamps have been shown and described where the two parts are both extrusions or sheet metal, it should be understood that a combination may have particular advantage in certain applications. For example, the ball might be an extrusion with the socket sheet metal, and vice versa. This again would give great flexibility in design features, particularly when curves or specific angles might be desired in a three-dimensional unit.

Also certain forms other than sheet metal may be made by die casting, extruding, permanent mold, etc.

The axial interlock or detent along the lines of FIGS. 8 and 9 has the distinct advantage that the parts will stay together while being handled up to and including application. The parts will remain nested and the axial detent prevents them moving relative to each other along the axis of rotation, be it a bead and groove or the spherical shape in FIG. 8. They could be assembled by slipping them together at right angles and then twisted to give engagement in the proper congruent relationship.

The cocked angle system of FIG. 7 will keep the holes lined up for easy insertion of the stripped end of the wire. In short, the connector tends to stay in the open position. While elliptical surfaces have been indicated, it should be understood that the invention includes the use of any congruent noncircular geometric form, such as any suitable polygon or square based hook. These could have radii to make for easy angular displacement which would tend to return to the original congruent position upon removal of the external force. The contact there would be under some pressure and would distribute the current somewhat mpore easily between the two pieces in use. While the elliptical or noncircular surfaces have been shown in FIG. 7 as tending to hold the connector open causing a binding action in the closed position, it should be understood that this relationship could be reversed. For example, the elliptical or noncircular surfaces could be matched with the connector closed and when they are brought to the open position, the surfaces would bind, thereby temporarily holding the connector open. In the first form where the noncircular surfaces are matched in the open position, the connector parts would be under load or stress when closed, whereas in the second form where the noncircular surfaces are matched or mated in the closed position, the parts might be somewhat under stress in the open position. In either case, suitable clearance between the opposed surfaces 74–76 would be provided to obtain the desired action. With the cocked angle system using a noncircular geometric surface or axial detent, as in FIGS. 7–9, the arrangement would have advantages in a connector of this general type where the ball is stationary and the socket rotated.

In the form of FIGS 1–6, rotating the ball section while the socket is stationary permits design alternatives which permit the conductor to be more easily placed at a desired angle versus the mounting plate surface. It could be at 90° to the plate for certain uses. Angles other than zero would be particularly well suited to sheet metal stamping design.

While the form in FIGS. 7–9 has been shown as cast, it should be understood that certain of thee features could be easily used in a sheet metal or stamped form similar to FIG. 5, be it a double or single unit and regardless of whether the ball or socket rotates.

While a preferred form and several variations of the invention have been shown and described, it should be understood that suitable additional modifications, changes, substitutions and alterations may be made without departing from the invention's fundamental theme.

The embodiments of the invention in which an exclusive property or privelege is claimed are defined as follows:

1. In a clamp connector for cables and the like, a ball and socket rotatably mounted with respect to each other with the ball in the socket, tails projecting from the ball and socket and adapted to be generally parallel of each other and in contact when the connector is closed and separated and somewhat divergent when the connector is open, the engaged surfaces between the ball and socket being noncircular and oriented so that the connector tends to stay in its open position, registrable apertures in the tails for joining the connector to a body and for rotating the ball within the socket, and openings disposed generally diametrically through the ball and socket providing wire-distorting surfaces which are disposed to receive the stripped end of a wire when the connector is open and to be in wire-distorting position when the connector is closed.

2. The structure of claim 1 further characterized in that the engaged surfaces between the ball and socket are elliptical.

3. The structure of claim 2 further characterized in that the elliptical surfaces are in registry when the connector is open.

4. The structure of claim 2 further characterized in that the elliptical surfaces are in registry when the connector is closed.

5. In a clamp connector for cables and the like, a ball and socket rotatably mounted with respect to each other with the ball in the socket, tails projecting from the ball and socket and adapted to be generally parallel with each other and in contact when the connector is closed and separated and somewhat divergent when the connector is open, registrable apertures in the tails for joining the connector to a body and for rotating the ball relative to the socket, the connector having two pairs of balls and sockets oppositely disposed with the socket tails joined so that two wires may be connected, the balls being on opposite sides of the joined socket tails, and openings disposed generally diametrically through the ball and socket providing wire-distorting surfaces which are disposed to receive the stripped ends of a wire when the connector is open and to be in wire-distorting position when the connector is closed.

6. In a clamp connector for cables and the like, a ball and socket rotatably mounted with respect to each other with the ball in the socket, tails projecting from the ball and socket and adapted to be generally parallel with each other and in contact when the connector is closed and separated and somewhat divergent when the connector is open, registrable apertures in the tails for joining the connector to a body and for rotating the ball relative to the socket, openings disposed generally diametrically through the ball and socket providing wire-distorting surfaces which are disposed to receive the stripped ends of a wire when the connector is open and to be in wire-distorting position when the connector is closed, and a riser on the socket tail adjacent its intersection with the socket and projecting into a part of the diametrical opening in the ball when the connection is closed.

7. The structure of claim 6 further characterized by and including a concave crown on the top of the riser constructed and arranged to bear against and distort the wire when the connection is closed.

* * * * *